US008282371B2

(12) United States Patent
Hashida

(10) Patent No.: US 8,282,371 B2
(45) Date of Patent: Oct. 9, 2012

(54) SCREW PUMP

(75) Inventor: Koichi Hashida, Kariya (JP)

(73) Assignee: Advics Co., Ltd., Kariya, Aichi-Pref (JP)

( * ) Notice: Subject to any disclaimer, the term of this patent is extended or adjusted under 35 U.S.C. 154(b) by 589 days.

(21) Appl. No.: 12/508,213

(22) Filed: Jul. 23, 2009

(65) Prior Publication Data

US 2010/0021332 A1 Jan. 28, 2010

(30) Foreign Application Priority Data

Jul. 25, 2008 (JP) ..... 2008-191838

(51) Int. Cl.
*F01C 21/10* (2006.01)
*F03C 2/00* (2006.01)
*F03C 4/00* (2006.01)
*F04C 2/00* (2006.01)

(52) U.S. Cl. ..... 418/150; 418/197; 418/201.3

(58) Field of Classification Search ..... 418/197, 418/201.1, 201.3, 206.1, 206.4, 150
See application file for complete search history.

(56) References Cited

U.S. PATENT DOCUMENTS 1,965,557 A * 7/1934 Montelius ..... 418/201.1
2,231,357 A * 2/1941 Erb et al. ..... 418/201.1
2,693,763 A * 11/1954 Sennet ..... 418/197
3,814,557 A * 6/1974 Volz ..... 418/197
4,773,837 A 9/1988 Shimomura et al.
7,234,925 B2 6/2007 Beaven et al.

FOREIGN PATENT DOCUMENTS

GB 486034 * 5/1938 ..... 418/197
JP 61-294178 A 12/1986

* cited by examiner

*Primary Examiner* — Theresa Trieu

(74) *Attorney, Agent, or Firm* — Buchanan Ingersoll & Rooney PC

(57) ABSTRACT

A screw pump includes a casing including a main accommodating bore and plural sub accommodating bores, a main rotor adapted to be rotatably accommodated in the main accommodating bore, and plural sub rotors adapted to be respectively rotatably accommodated in the sub accommodating bores. Each sub rotor is adapted to engage the main rotor. A cross sectional shape of a flank surface of the main rotor, which is taken in a direction perpendicular to an axial direction of the main rotor, is formed along an epitrochoid traced by an edge of the sub rotor not to include an undercut shape. Further, a cross sectional shape of a flank surface of each sub rotor, which is taken in a direction perpendicular to an axial direction of the sub rotor, is formed along an epitrochoid traced by an edge of the main rotor not to include an undercut shape.

2 Claims, 3 Drawing Sheets

SCREW PUMP

CROSS REFERENCE TO RELATED APPLICATIONS

This application is based on and claims priority under 35 U.S.C. §119 to Japanese Patent Application 2008-191838, filed on Jul. 25, 2008, the entire content of which is incorporated herein by reference.

FIELD OF THE INVENTION

The present invention relates to a screw pump including a main rotor and a plurality of sub rotors.

BACKGROUND

As an example a screw pump including first, second and third screw type rotors, JP1986-294178A (hereinafter, referred to as reference 1) discloses a screw pump including a main rotor, which is accommodated in a main accommodating bore formed at a casing, and two sub rotors, which are respectively accommodated in two sub accommodating bores formed at the casing so as to be in parallel with the main accommodating bore. A helical thread (i.e., a helical tooth portion and a helical groove portion) is formed at each of the main rotor and the two sub rotors. Each sub rotor meshes the main rotor, so that each sub rotor is driven to rotate.

Generally, a distance between a central axis of the main accommodating bore and a central axis of each sub accommodating bore, a root circle diameter (thread root circle diameter) of the main rotor, and a pitch circle diameter (thread top circle diameter) of each of the sub rotors are arranged to match one another. In such condition, ideally, a cross sectional shape of a flank surface of the main rotor, which is taken in a direction perpendicular to an axial direction of the main rotor, is formed along an epicycloid traced by an edge of the sub rotor (i.e., by a boundary point between a flank surface and a thread top surface of the sub rotor). The epicycloid may be defined as a specific kind of epitrochoid. However, in the description enclosed herein, the term "epitrochoid" does not include the meaning of "epicycloid".

Further, according to a known screw pump including first, second and third screw type rotors, each of the above described three dimensions (i.e., a distance between the central axes of a main accommodating bore and a sub accommodating bore, a thread root circle diameter of a main rotor and a thread top circle diameter of each sub rotor) is generally determined to be 0.6 times longer than a pitch circle diameter (thread top circle diameter) of the main rotor, while a root circle diameter (thread root circle diameter) of each sub rotor is determined to be substantially 0.2 times longer than the thread top circle diameter of the main rotor.

Still further, as another example of a known screw pump including a main rotor and two sub rotors, U.S. Pat. No. 7,234,925B2 (hereinafter, referred to as reference 2) discloses a screw pump, in which the above described dimensions (i.e., a distance between central axes of a main accommodating bore and a sub accommodating bore, a thread root circle diameter of a main rotor and a thread top circle diameter of each sub rotor) are not arranged to match one another. Specifically, the reference 2 discloses that the thread root circle diameter of each sub rotor is preferably determined to be less than 0.31 times the length of the thread top circle diameter of the main rotor. In such condition, a cross sectional shape of a flank surface of the main rotor, which is taken in a direction perpendicular to an axial direction of the main rotor, is formed along an epitrochoid. Further, the thread root circle diameter of the main rotor is determined to be larger than a distance between an axis of the main rotor and an axis of the sub rotor.

However, according to the reference 1, when seen in a cross section, because the epicycloids is employed as a theoretical line along which the flank surface of the main rotor is to be formed, a corner portion is formed at a connecting portion between the flank surface and a thread root portion of the main rotor. Accordingly, forming the thread portion along the theoretical line may be difficult. Specifically, at least a minimum corner portion R is required to be formed at the connecting portion between the flank surface and the thread root portion of the main rotor, and such corner portion R is accordingly required to be formed at the edge of the sub rotor. So configured, the shape of the flank surface of the sub rotor may become further different from its theoretical shape. Accordingly, a clearance generated between the main rotor and each sub rotor become larger when the main rotor and each sub rotor mesh with each other, so that leakage of the fluid may be increased.

Further, as a processing manner, a roll-forming process is known to be more advantageous than a cutting (grinding) process in processing accuracy and processing time. However, according to the reference 1, the flank surface of the sub rotor is recessed, in a rotational direction thereof, further than a line connecting a center and the edge of the sub rotor. Thus, the flank surface of the sub rotor is formed to have an undercut shape. Accordingly, the roll-forming process does not suit the forming of the sub rotor.

Still further, because the thread root circle diameter of the sub rotor becomes smaller, a resistibility of the sub rotor may be reduced specifically when downsizing the screw pump. Accordingly, in case where the sub rotor is formed by the roll-forming process, the material of the sub rotor may be deformed or damaged. Due to such circumstances, the processing manner of the rotors may be therefore restrained.

In a condition where the thread root circle diameter of the main rotor is determined to be larger than the distance between the axes of the main accommodating bore and the sub accommodating bore as disclosed in the reference 2, the flank surface of the main rotor is formed along the epitrochoid, and the flank surface and the thread root of the main rotor are continuously (smoothly) connected to each other. Accordingly, the shape of the flank surface of the sub rotor approaches the theoretical line, so that the leakage of fluid may be restrained from increasing. However, the reference 2 does not disclose a rotor, of which sub rotor includes a flank surface without an undercut shape and which is suitable to be formed by a roll-forming process.

A need thus exists for a screw pump, which is not susceptible to the drawback mentioned above.

SUMMARY OF THE INVENTION

According to an aspect of the present invention, a screw pump includes a casing, a main rotor and a plurality of sub rotors. The casing includes a main accommodating bore and a plurality of sub accommodating bores extending in parallel with the main accommodating bore and communicating with the main accommodating bore. The main rotor includes a helical tooth portion and a helical groove portion formed along the helical tooth portion. The main rotor is adapted to be accommodated in the main accommodating bore to be rotatably supported thereby. Each sub rotor includes a helical tooth portion and a helical groove portion formed along the helical tooth portion. The sub rotors are adapted to be respectively accommodated in the plurality of sub accommodating bores to be rotatably supported thereby. Further, the sub rotors are adapted to engage the main rotor and to be driven to rotate by a rotation of the main rotor. A cross sectional shape of a flank surface of the main rotor, which is taken in a direction perpendicular to an axial direction of the main rotor, is formed along an epitrochoid traced by an edge of the sub rotor not to include an undercut shape. Further, a cross sectional shape of a flank surface of each sub rotor, which is taken in a direction perpendicular to an axial direction of the sub rotor, is formed along an epitrochoid traced by an edge of the main rotor not to include an undercut shape.

BRIEF DESCRIPTION OF THE DRAWINGS

The foregoing and additional features and characteristics of the present invention will become more apparent from the following detailed description considered with the reference to the accompanying drawings, wherein.

DETAILED DESCRIPTION

An embodiment of the present invention will be described hereinbelow with reference to the attached drawings.

Figure 1:
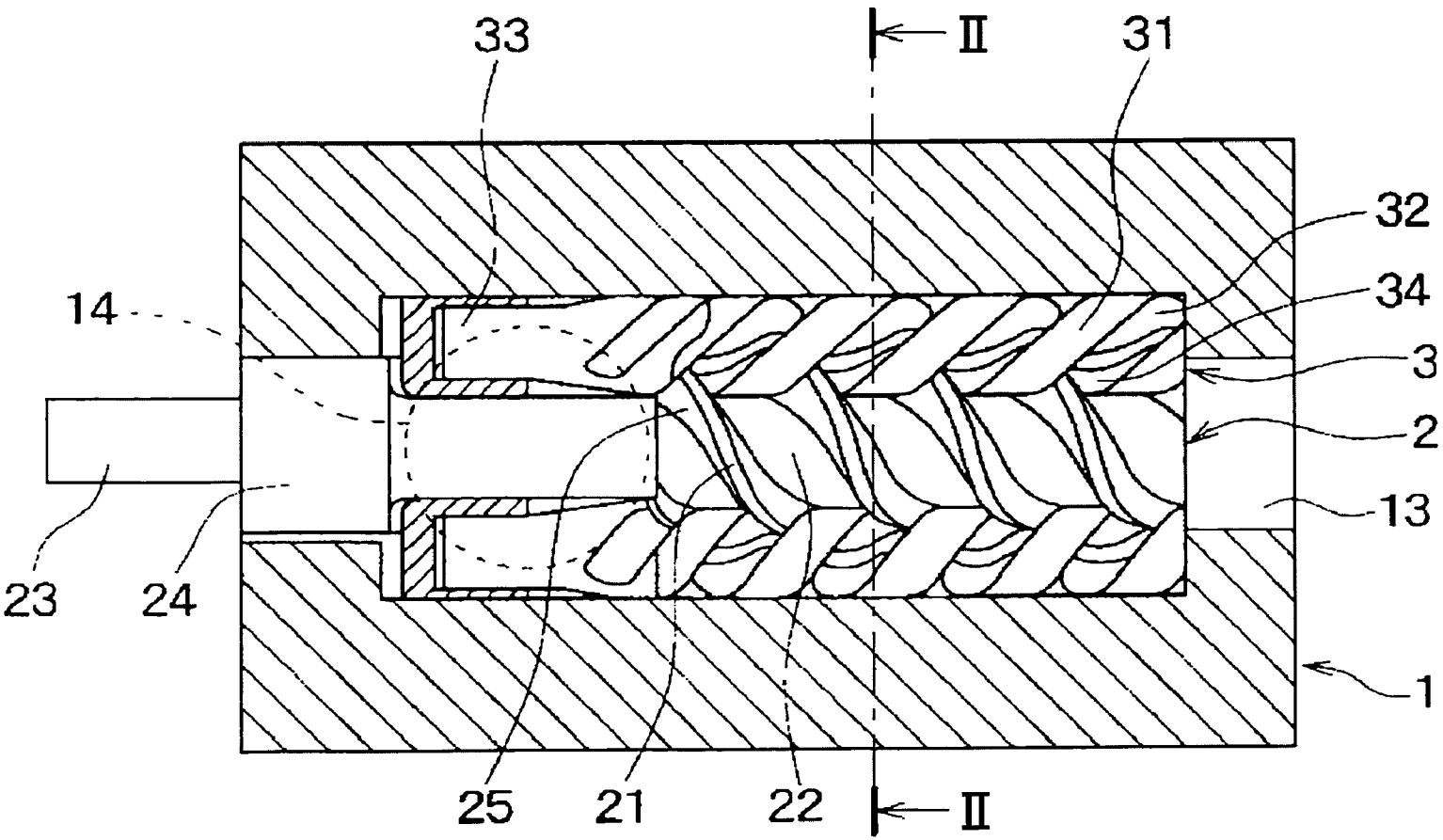
FIG. 1 is a cross sectional view illustrating a screw pump according to an embodiment.
Figure 2:
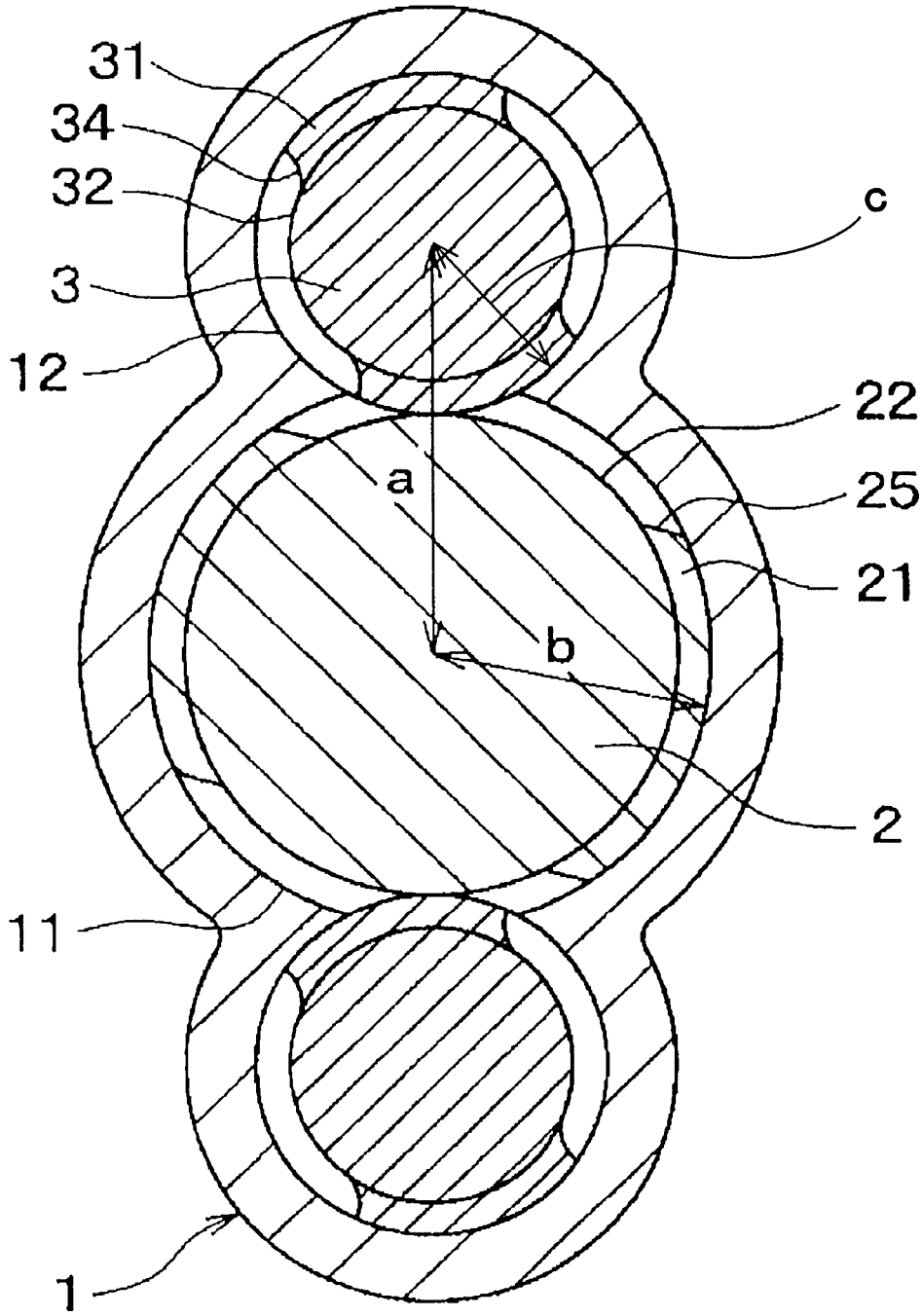
FIG. 2 is a cross sectional view of the screw pump, taken along in line II-II in FIG. 1.

As illustrated in FIGS. 1 and 2, a screw pump mainly includes a casing 1, a main rotor 2 and plural sub rotors 3 (according to the embodiment, two sub rotors 3).

The casing 1 includes a main accommodating bore 11 and plural sub accommodating bores 12 (according to the embodiment, two sub accommodating bores 12) extending in parallel with each other. Each of the accommodating bores 11 and 12 includes a substantially circular cross sectional shape in a direction perpendicular to an axial direction of each of the accommodating bores 11 and 12. Specifically, the main accommodating bore 11 is located at a central position of the casing 1, and the sub accommodating bores 12 are located at diametrical sides of the main accommodating bore 11. A total value of an inner radius of the main accommodating bore 11 and an inner radius of each sub accommodating bore 12 is determined to be greater than a distance defined between a central axis of the main accommodating bore 11 and a central axis of each sub accommodating bore 12. Accordingly, the main accommodating bore 11 and each sub accommodating bore 12 are in communication with each other. An inlet port 13 is formed at one end portion (one axial end portion) of the casing 1, while an outlet port 14 is formed at another end portion (another axial end portion) of the casing 1. An operational fluid is adapted to be drawn into the casing 1 through the inlet port 13 and to be discharged from the casing 1 through the outlet port 14.

The main rotor 2 is rotatably accommodated in the main accommodating bore 11 of the casing 1. A thread configured with a helical tooth portion 21 and a helical groove portion 22 is formed at one axial end portion of the main rotor 2. Specifically, the helical tooth portion 21 is formed at the main rotor 2 at an area defined between the inlet port 13 and the outlet port 14 of the casing 1, while the helical groove portion 22 is formed at the main rotor 2 along the helical tooth portion 21. An outer circumferential rim (i.e., a thread top surface) of the helical tooth portion 21 of the main rotor 2 slidably contacts an inner circumferential surface of the main accommodating bore 11.

A driving end portion 23 is formed at another axial end portion of the main rotor 2 so as to protrude from the casing 1 when assembled thereon. A driving means, such as a motor, is connected to the driving end portion 23 of the main rotor 2, so that the main rotor 2 is driven to rotate by means of the driving means.

Further, a cylindrical (short-length cylindrical) journal portion 24 is formed at the main rotor 2 at a position defined between the helical tooth portion 21 (i.e., the helical groove portion 22) and the driving end portion 23. The main rotor 2 is rotatably supported by the casing I via the journal portion 24. The casing 1 is structured in a substantially fluid-tight manner at the portion where the journal portion 24 of the main rotor 2 is positioned. The operational fluid draining from the casing 1 through a small clearance formed between the casing 1 and the journal portion 24 is collected by a drain circuit.

As will be described below, a cross sectional shape of a flank surface 25 of the main rotor 2, which is taken in a direction perpendicular to the axial direction of the main rotor 2, is formed along an epitrochoid traced by an edge of the sub rotor 3 (i.e., by a boundary point between a flank surface 34 and a thread top surface of each sub rotor 3).

The sub rotors 3 are accommodated in the sub accommodating bores 12 and are rotatably supported thereby, respectively. According to the embodiment, two sub rotors 3 are accommodated in the two sub accommodating bores 12, respectively. The sub rotors 3 include the same structures. A thread configured with a helical tooth portion 31 and a helical groove portion 32 is formed at one axial end portion of each sub rotor 3. Specifically, the helical tooth portion 31 is formed at each sub rotor 31 at an area defined between the inlet port 13 and the outlet port 14 of the casing 1, while the helical groove portion 32 is formed at each sub rotor 3 along the helical tooth portion 31. An outer circumferential rim (a thread top surface) of the helical tooth portion 31 of each sub rotor 3 slidably contacts an inner circumferential surface of the corresponding sub accommodating bore 12. Further, a cylindrical (short-length cylindrical) journal portion 33 is formed at another axial end portion of each sub rotor 3 and is rotatably supported by the casing 1.

As will be described below, a cross sectional shape of the flank surface 34 of each sub rotor 3, which is taken in a direction perpendicular to the axial direction thereof, is formed along an epitrochoid traced by an edge of the main rotor 2 (i.e., by a boundary point between the flank surface 25 and a thread top surface of the main rotor 2).

A helical direction of the thread (the helical tooth portion 21 and the helical groove portion 22) of the main rotor 2 is opposite to a helical direction of the thread (the helical tooth portion 31 and the helical groove portion 32) of the sub rotor 3. The helical tooth portion 21 of the main rotor 2 fits into the helical groove portion 32 of each sub rotor 3, while the helical tooth portion 31 of each sub rotor 3 fits into the helical groove portion 22 of the main rotor 2. Thus, the main rotor 2 and each sub rotor 3 mesh with each other. Further, because the main rotor 2 is driven to rotate by the driving means, each sub rotor 3 is also driven to rotate in accordance with the rotation of the main rotor 2.

So configured, when the main rotor 2 is driven to rotate by the driving means in a predetermined rotational direction, each sub rotor 3 is driven to rotate in a rotational direction opposite to the rotational direction of the main rotor 2. Thus, because of the rotations of the main rotor 2 and the sub rotors 3, a low-pressure operational fluid is drawn to the casing 1.

The operational fluid fills the helical groove portion 22 of the main rotor 2 and the helical groove portion 32 of each sub rotor 3 and then flows in the axial direction of the main rotor 2 (the axial direction of the sub rotors 3) towards the outlet port 14 while being pressurized. Thus, the low-pressure operational fluid is drawn to the casing 1 and the pressurized operational fluid is discharged therefrom.

Because each of the flank surface 25 of the main rotor 2 and the flank surface 34 of the sub rotor 3 is formed along the epitrochoid, the main rotor 2 and each sub rotor 3 move relative to each other while the edge of the main rotor 2 is in contact with the flank surface 34 of the sub rotor 3 and the edge of the sub rotor 3 is in contact with the flank surface 25 of the main rotor 2. Thus, the operational fluid encapsulated in each of the helical groove portions 22 and 32 is discharged from the casing 1 without leaking to the adjacent helical groove portion.

Figure 3:
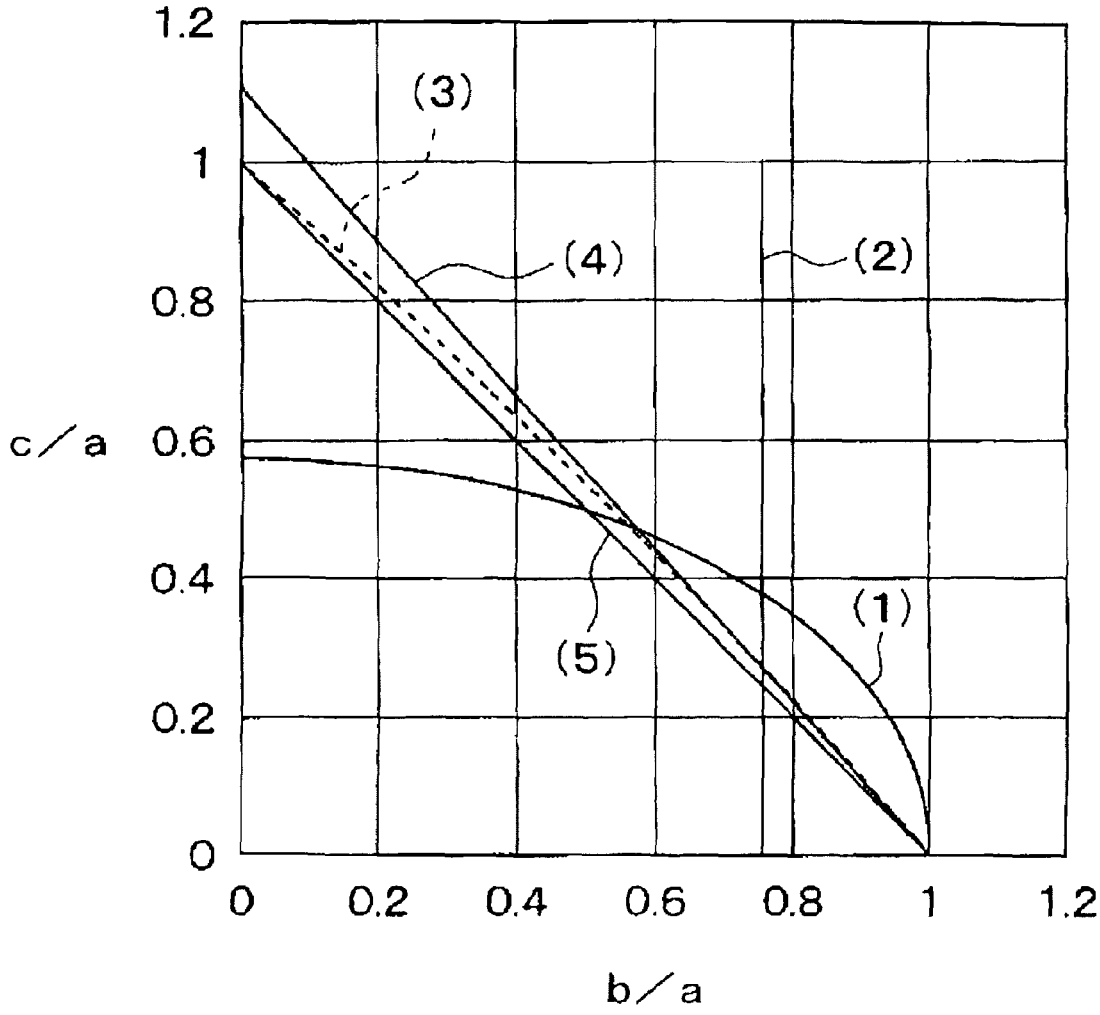
FIG. 3 is a diagram illustrating a relationship between a distance between axes of a main rotor and a sub rotor, a thread top circle radius of the main rotor and a thread top circle radius of the sub rotor.

Features of the screw pump according to the embodiment will be described hereinbelow. The distance between the central axes of the main accommodating bore 11 and each sub accommodating bore 12 is assigned as a distance a. A pitch circle radius (thread top circle radius) of the main rotor 2 is assigned as a thread top circle radius b, and a pitch circle radius (thread top circle radius) of the sub rotor 3 is assigned as a thread top circle radius c. Accordingly, a root circle radius (thread root circle radius) of the main rotor 2 is obtained by subtracting the thread top circle radius c from the distance a and is indicated as "a−c". Further, a root circle radius (thread root circle radius) of each sub rotor 3 is obtained by subtracting the thread top circle radius b from the distance a and is indicated as "a−b". According to a known screw pump, the ratio of values of the distance a, the thread top circle radius b and the thread top circle radius c is generally determined as follows: a=1.2b; and c=0.6b. In FIG. 3, an axis of abscissa indicates "b/a" while an axis of ordinate indicates "c/a", and conditions obtained as described below are indicated in a graph of FIG. 3.

First, so as not to form a corner portion at a portion rising (protruding) from the root circle of the main rotor 2 (i.e., at a connecting portion between the flank surface 25 and the root circle of the main rotor 2), the flank surface 25 is formed along the epitrochoid. In order to achieve such condition, the thread root circle radius "a−c" of the main rotor 2 is determined to be larger than half a value of the distance a. Accordingly, a condition "a−c>a/2", i.e., "c<a/2" is obtained. In case where other required conditions are satisfied as will be described below, the condition "a−c>a/2", i.e., "c<a/2" is obtained.

Next, a condition where an undercut is not formed at the flank surface 34 of the sub rotor 3 will be explained. Herein, in XY coordinates, a rotational axis of the thread root circle of the sub rotor 3 is assigned to correspond to an origin of the coordinates, i.e., (x, y)=(0, 0). Then, in conditions where a thinnest thread point "a−b" is assigned on X coordinate and a parameter θ is assigned as zero, a starting point of the epitrochoid to be traced by the edge of the main rotor 2 is indicated as follows: (x, y)=((a−b, 0). Then, the locus of the epitrochoid, which is traced by the edge of the main rotor 2 in accordance with a change of a parameter θ (i.e., in accordance with a rotation of the main rotor 2) from the starting point (a−b, 0), will be obtained as follows:

$$(x, y)=(a\cdot\cos\theta-b\cdot\cos 2\theta,\ a\cdot\sin\theta-b\cdot\sin 2\theta).$$

Further, a velocity vector of the locus of the epitrochoid traced in accordance with the change of the parameter θ will be obtained as follows:

$$\left(\frac{dx}{d\theta}, \frac{dy}{d\theta}\right) = (-a\cdot\sin\theta + 2b\cdot\sin 2\theta,\ a\cdot\cos\theta - 2b\cdot\cos 2\theta).$$

A critical condition where the undercut shape is not formed, i.e., a condition where a vector from an origin of the coordinates to a point on the locus of the epitrochoid and the velocity vector are arranged to be in parallel, will be obtained as follows:

$$(a\cdot\cos\theta - b\cdot\cos 2\theta)(a\cdot\cos\theta - 2b\cdot\cos 2\theta) = (a\cdot\sin\theta - b\cdot\sin 2\theta)(-a\cdot\sin\theta + 2b\cdot\sin 2\theta).$$

Thus, a formula 1 is obtained as follows by applying the formula of trigonometric function to the above described formula:

$$\cos\theta=(a^2+2\cdot b^2)/(3ab).$$

Herein, a square of the value of a distance from the origin of the coordinates will be obtained as follows:

$$(a\cdot\cos\theta - b\cdot\cos 2\theta)^2 + (a\cdot\sin\theta - b\cdot\sin 2\theta)^2 = a^2 + b^2 - 2ab(\cos\theta\cos 2\theta + \sin\theta\sin 2\theta) = a^2 + b^2 - 2ab\cdot\cos\theta.$$

Further, by assigning the formula 1 to the formula described above, a formula is obtained as follows:

$$a^2 + b^2 - 2ab\cdot\cos\theta = a^2 + b^2 - 2ab\cdot(a^2 + 2\cdot b^2)/(3ab) = (a^2 - b^2)/3.$$

Still further, so as not to form the undercut at the flank surface 34 of the sub rotor 3, the square of the thread top circle radius c of the sub rotor 3 is arranged to be smaller than a value obtained by the above described formula. In other words, a formula $c^2<(a^2-b^2)/3$, i.e., a formula "$3c^2+b^2<a^2$", is a necessary and sufficient condition for not generating the undercut. In FIG. 3, a line (1) indicates a critical line ($3c^2+b^2=a^2$) for not forming the undercut at the flank surface 34 of the sub rotor 3, i.e., the undercut is not formed at the flank surface 34 of the sub rotor 3 with values of (a, b, c) satisfying a formula "$3c^2+b^2\leqq a^2$".

According to U.S. Pat. No. 7,234,925B2, a thread root circle diameter of the sub rotor 3 is arranged to be less than 0.31 times the length of a thread top circle diameter of the main rotor 2. However, so as to ensure a resistibility of the sub rotor 3 and to easily form the sub rotor 3 by the roll-forming process, the thread root circle of the sub rotor 3 is preferably arranged to be greater. More specifically, according to the embodiment, the thread root circle diameter of the sub rotor 3 is determined to be equal to or greater than ⅓ times the length of the thread top circle diameter of the main rotor 2. Such condition is indicated as follows with reference to the distance a, the thread top circle radius b of the main rotor 2 and the thread top circle radius c of the sub rotor 3: a−b≧b/3. In other words, a value obtained by a formula "b≦0.75a" is assigned as a condition where the thread root circle diameter of the sub rotor 3 is determined to be equal to or greater than ⅓ times the length of the thread top circle diameter of the main rotor 2. In FIG. 3, a line (2) indicates a formula "b=0.75a", i.e., a condition where the thread root circle diameter of the sub rotor 3 is ⅓ times longer than the thread top circle diameter of the sub rotor 2.

The conditions described above are satisfied when the values b and c are relatively smaller than the value of the distance a. However, in a condition where the total value of b and c (b+c) approximates the value of the distance a, an angle of a corner edge (sharp edge) formed at a connecting portion between the main accommodating bore 11 and each sub accommodating bore 12 of the casing 1 (hereinafter, the angle is referred to as a cross-corner angle) becomes narrower, so that a processing of the casing 1 may be difficult.

With reference to a triangle having sides a, b and c, the cross-corner angle formed at the casing 1 is a supplementary angle which faces the side a of the triangle. On the basis of the cosine law, a necessary and sufficient condition for ensuring the cross-corner angle of the casing 1 to be equal to or greater than 30 degrees is indicated as follows:

$$a^2 \leq b^2 + c^2 - 2bc \cdot \cos 150^\circ = b^2 + c^2 + \sqrt{3} \cdot bc$$

Further, a condition for ensuring a groove depth "b+c−a" to be equal to or greater than 0.1 times the length of the thread top circle radius c of the sub rotor 3 is indicated as "b+c−a≧0.1c", i.e., "b+0.9c≧a". Herein, when the same combination of values of (a, b, c) are applied to each of formulas "$a^2=b^2+c^2+\sqrt{3}\cdot bc$" and "b+0.9c=a", substantially the same values are practical obtained from the both formulas.

Specifically, in FIG. 3, a line (3) indicates the condition where the cross-corner angle of the casing 1 is 30 degrees, i.e., the condition indicated by the formula "$a^2=b^2+c^2+\sqrt{3}\cdot bc$". Further, a line (4) indicates the condition where the groove depth "b+c−a" is 0.1 times longer than the thread top circle radius c of the sub rotor 3, i.e., the condition indicated by the equation "b+0.9c=a". With reference to FIG. 3, values indicated by the lines (3) and (4) are approximately the same. A line (5) illustrated in FIG. 3 indicates a formula "b+c=a".

With reference to FIG. 3, a condition "$3c^2+b^2 \leqq a^2$" and a condition "b=0.75a" are satisfied at an area surrounded by the lines (1), (2) and (5). Further, the condition "$3c^2+b^2 \leqq a^2$", the condition "b=0.75a" and the condition "b+0.9c≧a" are satisfied at an area surrounded by the lines (1), (2) and (3). Still further, as is apparent from FIG. 3, the combination of values of (a, b, c) satisfying the above described two or three conditions satisfies a condition indicated by a formula "c<a/2".

As an example of such combination of values of (a, b, c) satisfying the above described three conditions, 12, 8, 5 are applied to the values of (a, b, c), respectively. With such values "(a. b, c)=(12, 8, 5)", the groove depth (b+c−a) of each of the main rotor 2 and the sub rotor 3 is 0.2 times longer than the thread top circle radius c of the sub rotor 3, and the thread root circle diameter of the sub rotor 3 is 0.5 times longer than the thread top circle diameter of the main rotor 2. The flank surfaces 25, 34 of such rotors 2, 3 are formed by the roll-forming process, and the thread top surface of the thread of each rotor 2, 3 is then grinded by a centerless grinding process so that the thread top circle radius is determined to be a predetermined value. Thus, such rotors 2, 3 are comparatively easily produced.

According to the embodiment described above, because the condition "$3c^2+b^2 \leqq a^2$" is satisfied, an undercut is not formed at the flank surface 34 of the sub rotor 3. Further, because the condition "b≦0.75a" is satisfied, the thread root circle diameter of the sub rotor 3 is determined to be equal to or greater than ⅓ times the length of the thread top circle diameter of the main rotor 2. Accordingly, the practically satisfactory resistibility of the sub rotor 3 is obtained. Further, in combination of the above described conditions, the sub rotor 3 is formed by the roll-forming process. Still further, a processing accuracy of the sub rotor 3 is improved and a processing time for the sub rotor 3 is reduced.

Further, because the condition "b+0.9c≧a" is satisfied, the cross-corner angle is arranged to be equal to or greater than 30 degrees. Accordingly, the casing 1 is easily produced.

Although the elements other than the thread of the rotors (screws) are not specifically described, the embodiment disclosed herewith is applicable to known screw pump including three screws.

According to the embodiment, the thread root circle diameter of each sub rotor 3 is formed to be equal to or greater than ⅓ times the length of a thread top circle diameter of the main rotor 2.

Further, the cross corner angle (the angle of the corner edge formed at the connecting portion between the main accommodating bore 11 and each sub accommodating bore 12 of the casing 1) is determined to be equal to or greater than 30 degrees.

Still further, the following formulas are established: $3c^2+b^2 \leqq a^2$; and b≦0.75a. In such formulas, a indicates the distance between the central axis of the main accommodating bore 11 and the central axis of each sub accommodating bore 12, b indicates the thread top circle radius of the main rotor 2, and c indicates the thread top circle radius of the sub rotor 3.

Thus, because the condition "$3c^2+b^2 \leqq a^2$" is satisfied, an undercut is not formed at the flank surface 34 of the sub rotor 3. Further, because the condition "b≦0.75a" is satisfied, the thread root circle diameter of the sub rotor 3 is determined to be equal to or greater than ⅓ times the length of the thread top circle diameter of the main rotor 2. Accordingly, the practically satisfactory resistibility of the sub rotor 3 is obtained. Further, in combination of the above described conditions, the sub rotor 3 is formed by the roll-forming process. Still further, a processing accuracy of the sub rotor 3 is improved and a processing time for the sub rotor 3 is reduced.

Further according to the embodiment, the following formula is further established: b+0.9c≧a.

Still further, the main rotor 2 and each sub rotor 3 are formed by the roll-forming process.

In a condition where the total value of b and c (b+c) approximates the value of the distance a, the cross corner angle (i.e., the angle of the corner edge formed at the connecting portion between the main accommodating bore 11 and each sub accommodating bore 12 of the casing 1) becomes narrower, so that a processing of the casing 1 may be difficult. On the other hand, according to the embodiment, because the condition "b+0.9c≧a" is satisfied, the cross corner angle is arranged to be equal to or greater than 30 degrees. Thus, the casing 1 is easily produced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A screw pump, comprising:

a casing including a main accommodating bore and a plurality of sub accommodating bores extending in parallel with the main accommodating bore and communicating with the main accommodating bore;

a main rotor including a helical tooth portion and a helical groove portion formed along the helical tooth portion, the main rotor adapted to be accommodated in the main accommodating bore to be rotatably supported thereby;

a plurality of sub rotors each including a helical tooth portion and a helical groove portion formed along the helical tooth portion, the plurality of sub rotors adapted to be respectively accommodated in the plurality of sub accommodating bores to be rotatably supported thereby, the plurality of sub rotors adapted to engage the main rotor and to be driven to rotate by a rotation of the main rotor;

wherein a cross sectional shape of a flank surface of the main rotor, which is taken in a direction perpendicular to an axial direction of the main rotor, is formed along an epitrochoid traced by an edge of the sub rotor not to include an undercut shape, wherein a cross sectional shape of a flank surface of each sub rotor, which is taken in a direction perpendicular to an axial direction of the sub rotor, is formed along an epitrochoid traced by an edge of the main rotor not to include an undercut shape, and wherein the following formulas are established:

$$3c^2+b^2 \leqq a^2; \text{ and}$$

$$b \leqq 0.75a,$$

wherein a indicates a distance between a central axis of the main accommodating bore and a central axis of each sub accommodating bore, b indicates a thread top circle radius of the main rotor, and c indicates a thread top circle radius of the sub rotor.

2. A screw pump according to claim 1, wherein the following formula is further established:

$$b+0.9c \geqq a.$$

* * * * *